US007654269B1

(12) United States Patent
Boyle

(10) Patent No.: US 7,654,269 B1
(45) Date of Patent: Feb. 2, 2010

(54) HAIRBRUSH WITH DUAL REMOVABLE HANDLES AND ASSOCIATED METHOD

(76) Inventor: Ina Boyle, 2605 E. Finley Dr., Claysville, PA (US) 15323

( * ) Notice: Subject to any disclaimer, the term of this patent is extended or adjusted under 35 U.S.C. 154(b) by 294 days.

(21) Appl. No.: 11/726,423

(22) Filed: Mar. 22, 2007

(51) Int. Cl.
*A45D 24/16* (2006.01)
*A45D 24/00* (2006.01)
*A46B 5/00* (2006.01)

(52) U.S. Cl. ..... 132/120; 132/150; 15/145

(58) Field of Classification Search ..... 132/237, 132/120, 265, 150; 15/145, 143.1, 160
See application file for complete search history.

(56) References Cited

U.S. PATENT DOCUMENTS 4,811,445 A * 3/1989 Lagieski et al. ..... 15/104.94
D358,490 S 5/1995 Balster et al.
5,765,253 A * 6/1998 Martinez ..... 15/160
D414,610 S 10/1999 Davila
D417,083 S 11/1999 Yun
5,992,423 A 11/1999 Tevolini
6,029,307 A 2/2000 Baudoin
6,230,716 B1 5/2001 Minoletti
D460,271 S 7/2002 Denebeim
6,463,620 B2 10/2002 Busha
D466,696 S 12/2002 Van Dyk
6,502,585 B1 1/2003 Mazzei et al.
2008/0202545 A1 * 8/2008 Purvis et al. ..... 132/120

FOREIGN PATENT DOCUMENTS

GB 2347342 A * 9/2000
GB 2385265 A * 8/2003
GB 2445535 A * 7/2008

* cited by examiner

*Primary Examiner*—Robyn Doan
(74) *Attorney, Agent, or Firm*—Robert C. Montgomery

(57) ABSTRACT

A dual-handle hairbrush having first and second detachable handles provided on opposite ends of the brush in an axial manner. The second handle provides the ability to use either hand to style one's hair without flipping the brush, or it allows one to use both hands for greater control. Additionally, the two handles allow the consumer to use both hands for greater control. The hairbrush also includes a vented bristle canister to reduce drying time when used for blow-drying. The hairbrush provides removable handles which when removed, enables easy storage of the hairbrush in purses, drawers and suitcases while traveling.

9 Claims, 5 Drawing Sheets

HAIRBRUSH WITH DUAL REMOVABLE HANDLES AND ASSOCIATED METHOD

RELATED APPLICATIONS

The present invention was first described in Disclosure Document No. 602,279 filed on Jun. 14, 2006 the entire disclosures of which are incorporated herein by reference.

FIELD OF THE INVENTION

The present invention relates generally to hairbrushes and more particularly to a hairbrush with dual removable handles.

BACKGROUND OF THE INVENTION

Whatever one's personal hair style is, a hair brush is an important tool in keeping that style. While hair brushes do an admirable job of their task as evidenced by their long history from ancient times, they do suffer from the fact that they are designed to be held by only one hand at a time. Depending on the style of hair brush, a user must typically flip the brush back and forth depending on being held by the right hand or left hand. Others find that two hands on a brush mean greater control especially when curling or blow drying hair. This requires the user to grasp the brush end near the bristles where control is somewhat limited and the user runs the risk of burning their hands in the stream of hot air. Accordingly, there is a need for a means by which hair brushes can be held and controlled by either or both hands without the disadvantages as described above.

Several attempts have been made in the past to a hairbrush with dual removable handles. U.S. Pat. No. 6,502,585 in the name of Mazzei, et al discloses a hairstyling device for providing a user with a selection of interchangeable heads. The hairstyling device comprises a handle member. The handle member includes a first end and a second end. The first end of the handle member includes a cavity. The handle member includes a pair of elongated slots. There is a nub that includes a top wall, a peripheral wall integrally coupled to and extending away from the top wall. A free edge of the peripheral wall is integrally coupled to the first end of the handle member. There is a plurality of heads that include a first end and a second end with a peripheral wall extending therebetween. Each of the second ends of the heads includes a bore extending therein. Each of the bores includes a base wall and an inner side wall. The inner side wall includes a pair of wells therein. Each of the bores includes a size and shape designed for removably receiving the nub. There is a coupling means for removably connecting one of the heads to the handle member. The coupling means includes a size and shape designed for removably positioning in the pair of wells of one of the heads. Unfortunately, this prior art example does not provide a means of simultaneously attaching two separate handles to opposite ends of the brush head.

U.S. Pat. No. 6,463,620 in the name of Busha discloses a brush assembly, such as for cleaning and sanitizing toilet bowls, having a removable and disposable applicator head. The brush assembly comprises an elongated handle with a broadening diverging end and an applicator head for removable attachment thereto. Dual locking means for the applicator head are provided, where the locking means may be manually released without having to physically handle a soiled applicator head. Unfortunately, this prior art example is not suitable for use on hair growing from a human head.

U.S. Pat. No. 6,230,716 in the name of Minoletti discloses a hairbrush having a head that may be quickly removed from the brush handle and a hairbrush system utilizing the same. In its most basic form, the hairbrush includes a brush head having a plurality of bristles, a removable brush handle, and a quick disconnect mechanism for removably attaching the brush handle to the brush head such that the brush handle may be quickly removed from the brush head. In the preferred embodiment, the quick disconnect mechanism includes a rod extending from the brush handle with a spring loaded ball partially extending from the rod, and an opening disposed within the brush head for accepting the rod and retaining the ball. The preferred ball presses against a sleeve disposed within the opening in the brush head. In some embodiments, however, the sleeve is eliminated and the opening includes a keyway and retainer mates with the ball and holds the ball in place. The hairbrush system includes two or more cylindrical brush heads, at least one brush handle and a quick disconnect mechanism, each as described above. In the preferred system, at least two of the cylindrical brush heads are of different diameter. Unfortunately, this prior art example also does not provide a means of simultaneously attached two separate handles to opposite ends of the brush head. In addition, this prior art example does not include a vented brush head for allowing air to freely flow therethrough.

None of the prior art particularly describes a hairbrush with dual removable handles. Accordingly, there is a need for a hairbrush design, which provides a means of holding the hairbrush with either hand without the need for repeated flipping of the hairbrush. Additionally, there is a need for a hairbrush design, which allows the hairbrush to be held by both hands at once while effectively avoiding the risk of the hands being burnt during the blow-drying process. The development of the present invention fulfills these needs.

SUMMARY OF THE INVENTION

In view of the foregoing disadvantages inherent in the prior art, it has been observed that there is need for a hairbrush with dual removable handles.

The apparatus includes a vented canister including canister perforations advantageously formed therein, which is essential for allowing air to freely flow through the canister, and a plurality of bristles extending outwardly from an exterior surface of the canister. Such bristles allow a user to contact and capture an amount of hair growing from a user head, and manipulate the hair as desired for styling and drying. The vented canister allows a user to direct a force of air from a blow dryer-type of device onto the captured hair, and the perforations allow the directed air to advantageously penetrate the massed hair and thoroughly and quickly dry the hair faster than using a traditional, non-perforated canister.

A pair of axially opposed caps is coupled to opposed ends of the canister, and first and second handles are directly connected to the end caps, without the use of intervening elements, and extend outwardly from the canister along a path defined parallel to a longitudinal length of the canister. Such first and second handles are removably connected to the end caps respectively, and are advantageously sized and shaped such that a user can efficiently and comfortably manipulate the apparatus without experiencing muscle fatigue during operating conditions.

The end caps include a female coupling defining a hollow cavity formed in a lateral wall thereof. Each of the first and second handles include a male coupling removably mated within a corresponding one of the female couplings, which is critical such that each of the first and second handles are independently and simultaneously connected to the end caps respectively. Such female and male couplings are sized and shaped appropriately, which is crucial such that an amount of force applied to the handles by a user hand during normal operating conditions does not cause premature and undesirable separation of the handles from the vented canister.

The male couplings include an annular raised edge concentrically protruding about a circumference of medial ends of the first and second handles respectively. Each of the raised edges defines a shoulder against which the female couplings engage for advantageously preventing axial movement during operating conditions. Such an engagement maintains the handles abutted against the vented canister, which is necessary such that a linear or rotational force applied by a user hand to the handles is transferred to the vented canister, causing the handles and the vented canister to move in sync during operating conditions.

The ability to simultaneously attach two separate handles to opposite ends of a vented canister provides the unexpected benefit of allowing a user to grasp either handle without having to flip the apparatus during operating conditions. In addition, a first user can simultaneously grasp each handle with one hand, while a second user directs a flow of air or some other hair product onto the captured hair without contacting the first user hands with the directed air or hair product, and thereby preventing possible injury or discomfort to the first user. These unexpected benefits overcome the previously mentioned prior art shortcomings.

In operation, a method of assembling a hairbrush with dual removable handles includes the steps of providing a bristle canister, providing first and second handles that have male coupling portions seated at opposed end portions thereof respectively, providing first and second end caps that have female coupling portions formed at opposed end portions thereof respectively, securing the bristle canister in one hand, securing one of the first and second handles in another hand, inserting and engaging one of the female couplings with a corresponding one of the male couplings such that the one handle and the canister become securely locked together, transferring the canister and the one handle to the one hand, grasping another one of the first and second handles in the another hand, and inserting and engaging corresponding ones of the female and male couplings together such that the canister and the another handle securely lock together.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
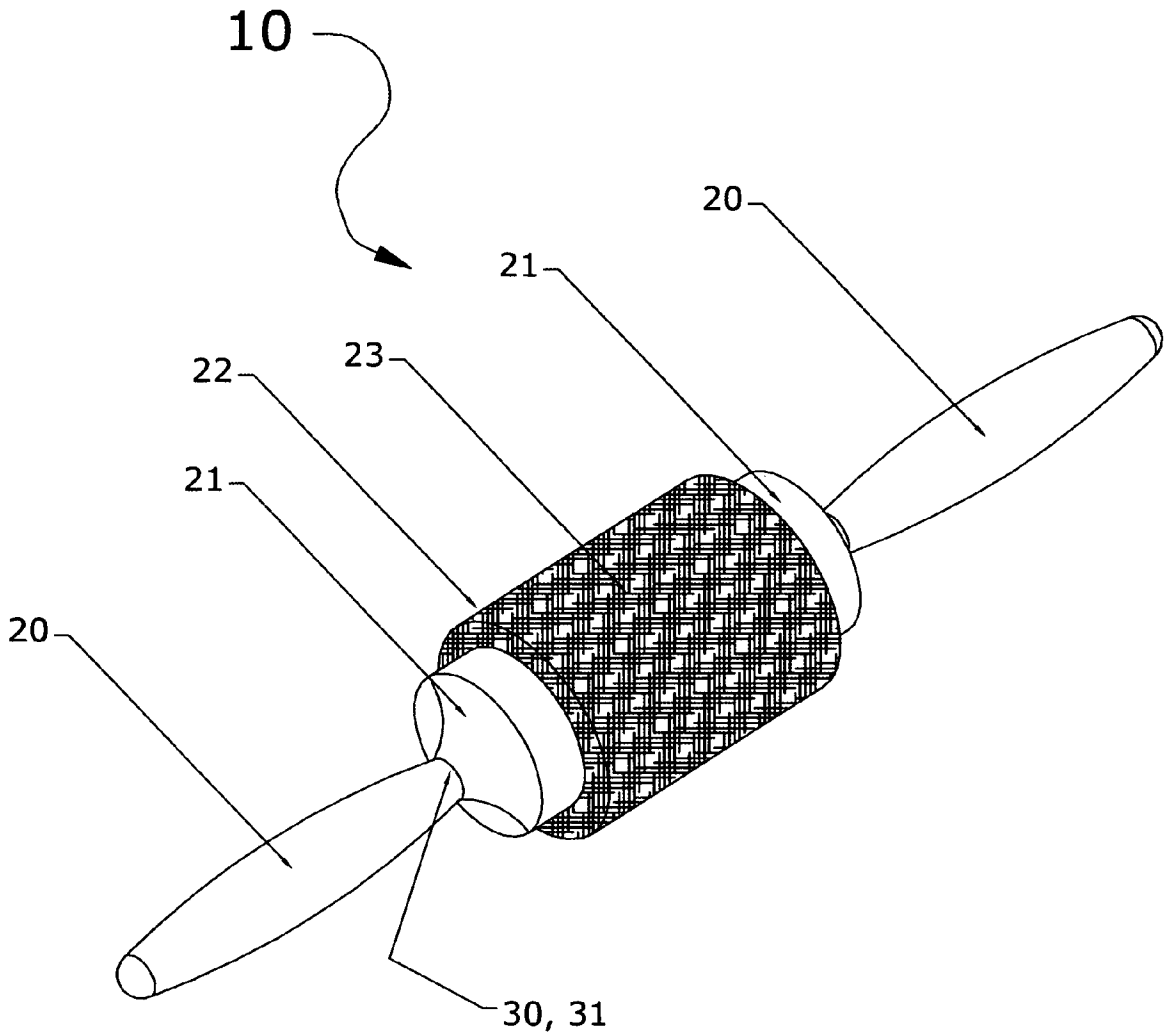
FIG. 1 is a perspective view of the hairbrush with dual removable handles 10, according to the preferred embodiment of the present invention.

10 hairbrush with dual removable handles
20 removable handles
21 canister end cap
22 vented bristle canister
23 canister perforations
30 receiving coupling feature
31 insert coupling feature

DETAILED DESCRIPTION OF THE PREFERRED EMBODIMENT

The best mode for carrying out the invention is presented in terms of its preferred embodiment, herein depicted within FIGS. 1 through 7. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Referring now to FIGS. 1 through 7, a hairbrush with dual removable handles 10 is depicted in accordance with a preferred embodiment of the present invention. As depicted in FIG. 1, the hairbrush with dual removable handles 10 comprises of a vented bristle canister 22. The vented bristle canister 22 is envisioned to be made from a variety of materials, such as, but not limited to, aluminum; chrome plated steel, and the like. The vented bristle canister 22 is envisioned to be made in a various diameters and lengths to meet different styling requirements. The vented bristle canister 22 contains canister perforations 23, which are designed to allow for the free flow of air through the hairbrush with dual removable handles 10 during blow-drying thereby reducing drying time. The canister perforations 23 are envisioned to be stamped or drilled in a variety of shapes, such as, but not limited to, circles, squares, rectangles, and the like. The bristle canister 22 is envisioned to contain bristles made of a variety of materials, such as, but not limited to, nylon, plastic, boars' hair, and the like. The vented bristle canister 22 is held securely between the two canister end caps 21. The canister end caps 21 are mechanically coupled to the removable handles 20.

Figure 2:
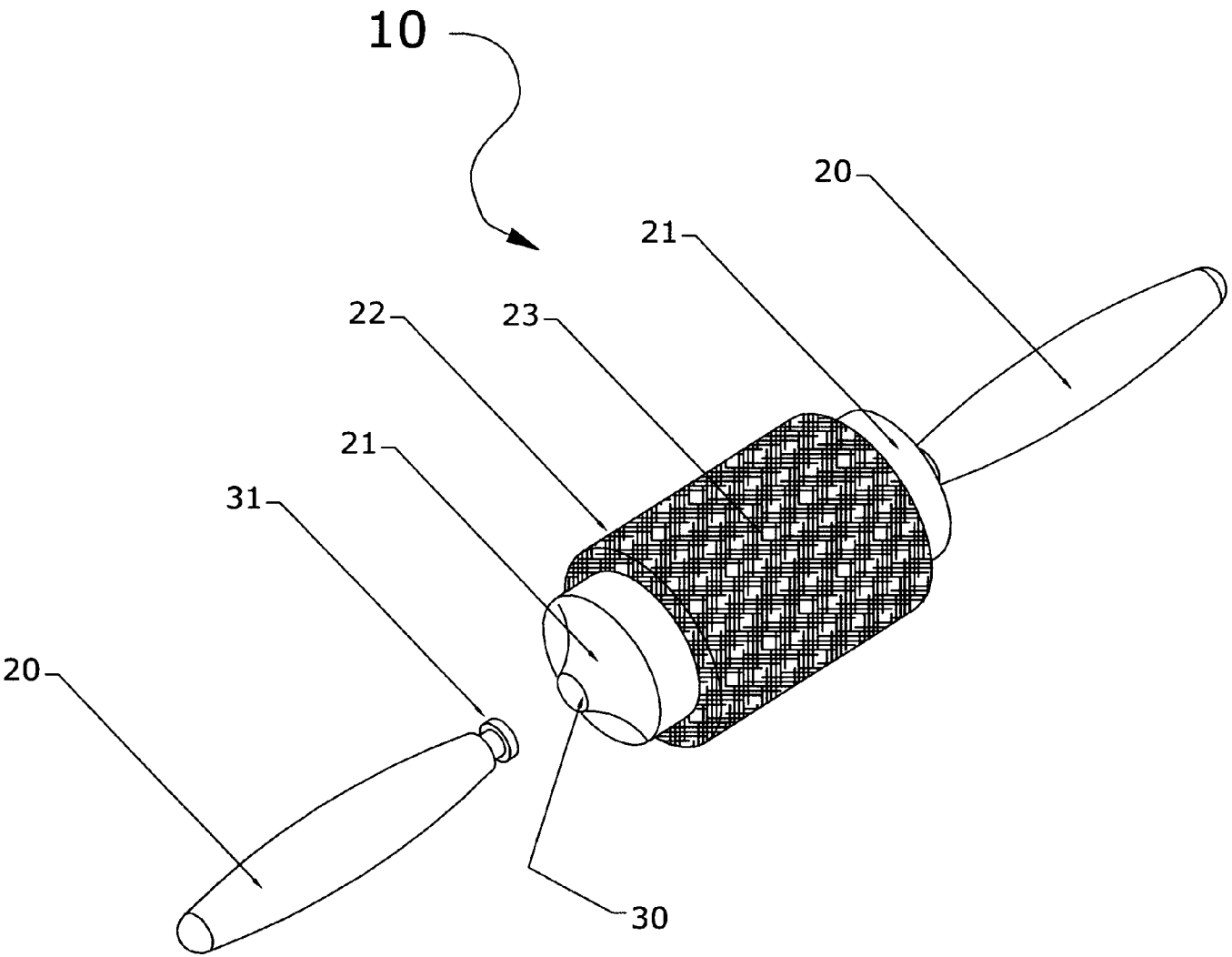
FIG. 2 is a perspective view of the hairbrush with dual removable handles 10 illustrating the second handle 20 in a detached configuration, according to the preferred embodiment of the present invention.

Depicted in FIG. 2, the hairbrush with dual removable handles 10 is illustrated with one of the removable handles 20 detached from the canister end caps 21 in accordance with a preferred embodiment of the present invention. The removable handles 20 are easily detached from the canister end cap 21 to provide several possible assembly configurations. The canister end caps 21 provide a receiving coupling feature 30 which mates securely with the corresponding coupling insert feature 31 designed into the removable handles 20. This connection between the receiving coupling feature 30 and the coupling insert feature 31, is envisioned to be a mechanical type, such as, but not limited to, a twist-and-lock, press-and-snap, or threaded connection, or the like. The connection between the receiving coupling feature 30 and the coupling insert feature 31 is such that easy attachment and detachment of the removable handles 20 is achieved. The removable handles 20 are envisioned to be made of a variety of materials, such as, but not limited to, plastic, metal, wood, or the like. The surface of the removable handles 20 is envisioned to include a graspable surface, such as, but not limited to, finger grooves, various rubber coatings, knurling surface, and such.

Figure 3:
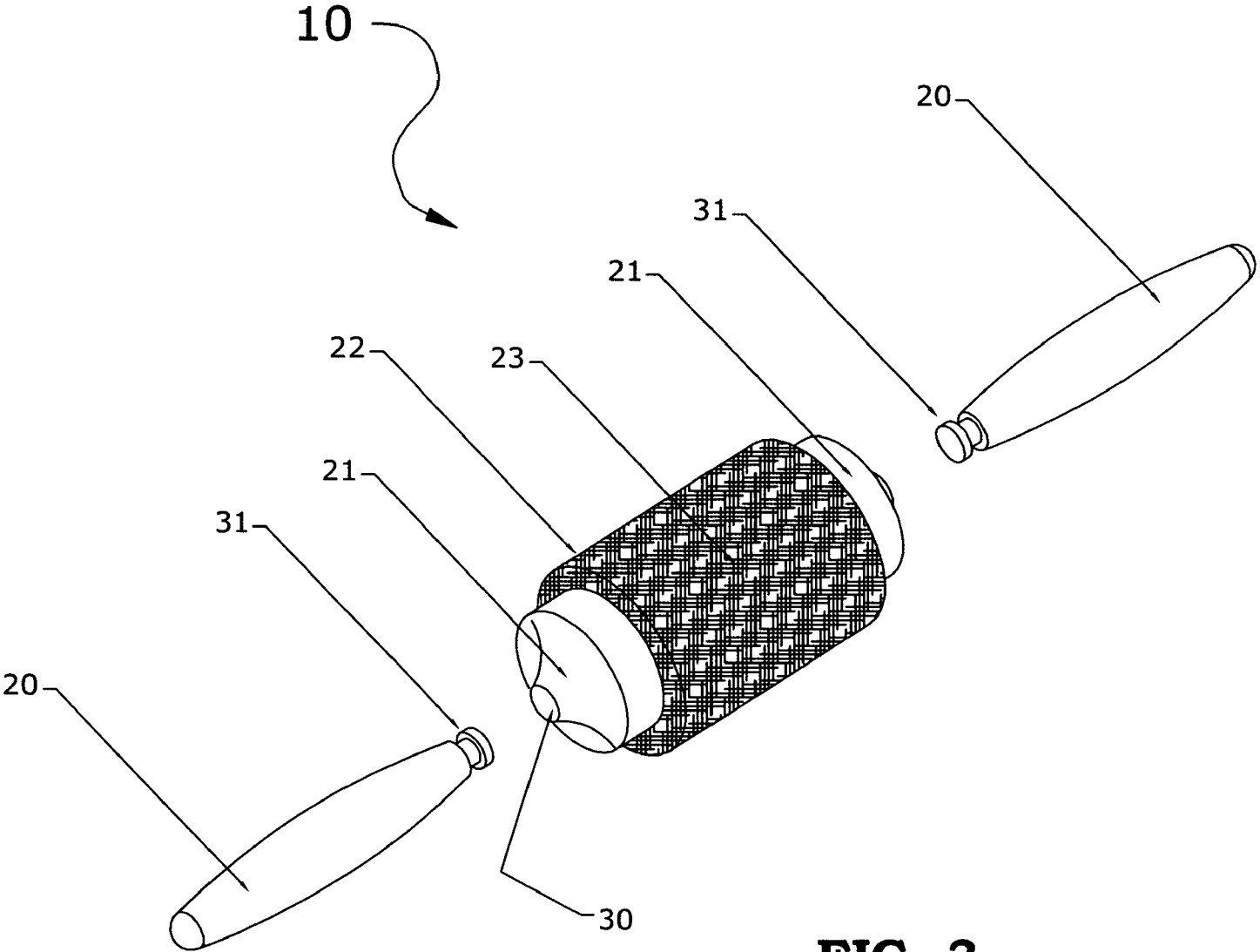
FIG. 3 is a perspective view of the hairbrush with dual removable handles 10 illustrating both handles 20 in a detached configuration for ease of storage or transportation, according to the preferred embodiment of the present invention.
Figure 4:
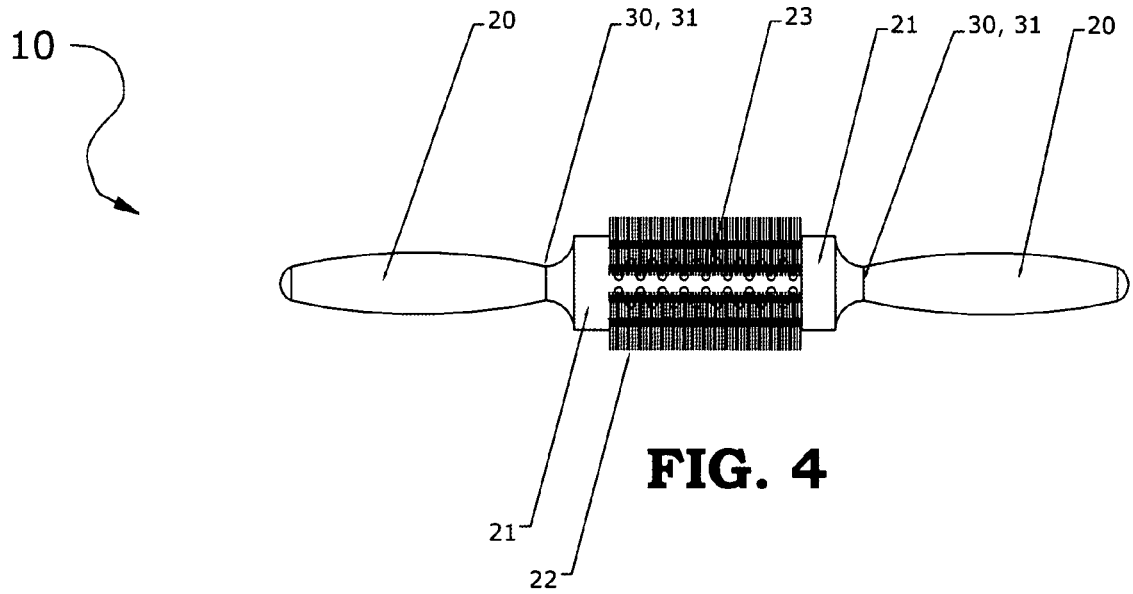
FIGS. 4 & 5 is an elevation view of the hairbrush with dual removable handles 10 illustrating small versions of the bristle canister 22, according to the preferred embodiment of the present invention; and, FIGS. 6 & 7 are elevational views of the hairbrush with dual removable handles 10 illustrating larger versions of the bristle canister 22, according to the preferred embodiment of the present invention.
Figure 5:
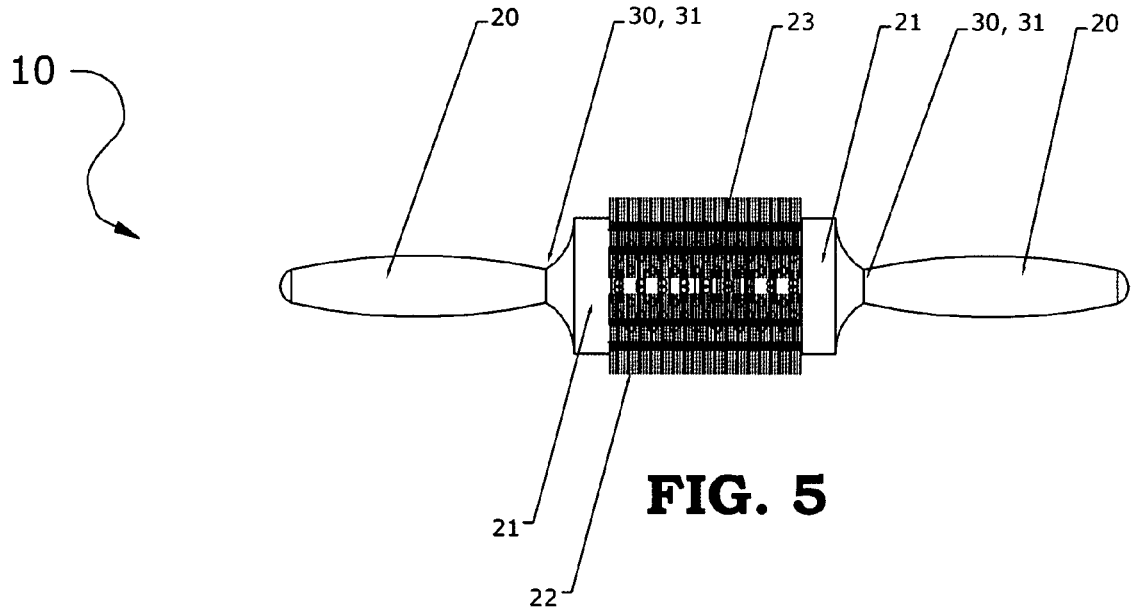
Figure 6:
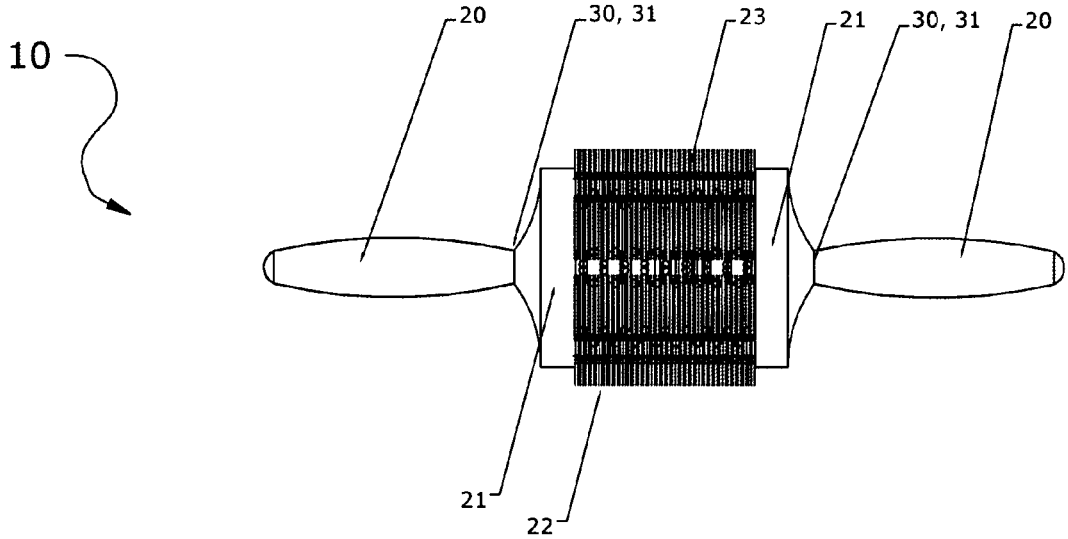
Figure 7:
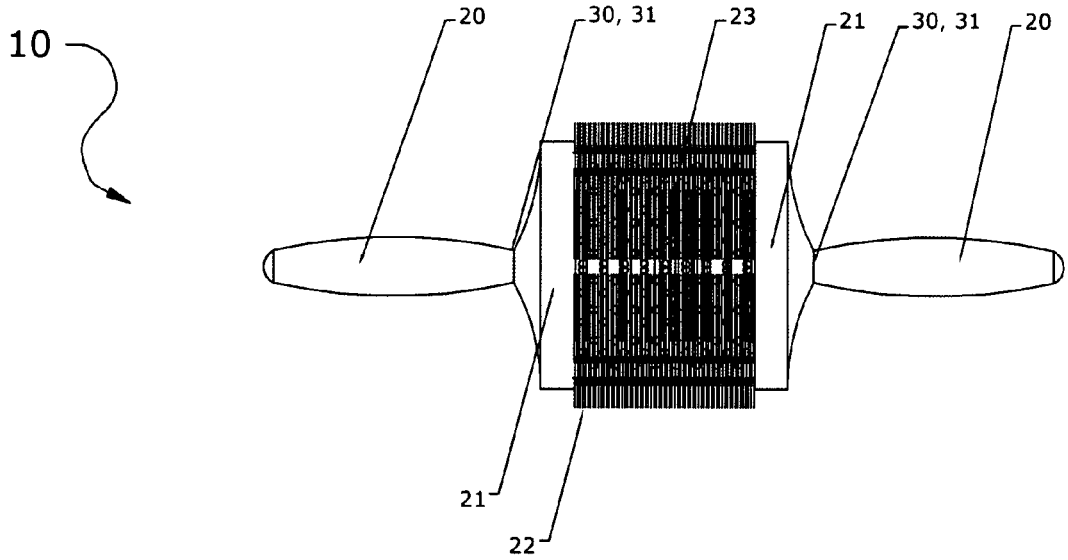

Depicted in FIG. 3, the hairbrush with dual removable handles 10 is illustrated with both removable handles 20 detached from the canister end caps 21 in accordance with a preferred embodiment of the present invention. Detachment of the two removable handles 20 reduces the overall length and enables easy storage of the hairbrush in purses, drawers and suitcases while traveling.

Depicted in FIGS. 4 through 7, the hairbrush with dual removable handles 10 is illustrated in different size ranges, such as, but not limited to, 2" to 6" in diameter to meet different styling requirements.

The preferred embodiment of the present invention can be utilized by a common user in a simple and effortless manor with little or no training.

The method of utilizing the hairbrush with dual removable handles may be achieved by performing the following steps: To assemble the hairbrush with dual removable handles, secure the bristle canister 22 in one hand and one of the two removable handles 20 in the other hand, insert and engage the receiving coupling feature 30 (in the canister end cap 21), and the insert coupling feature 31 (in the removable handle 20), and lock together securely. To assemble the second removable handle 20, hold the previous assembly in one hand and the second removable handle 20 in the other hand. Insert and engage the receiving coupling feature 30 (in the canister end cap 21), and the insert coupling feature 31 (in the removable handle 20), and lock together securely. The hairbrush with dual removable handles is now assembled in the two-handle configuration.

To assemble the hairbrush with dual removable handles 10 in the single removable handle configuration, simply attach only one of the two removable handles.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A hairbrush comprising:

a vented canister including canister perforations formed therein for allowing air to freely flow through said canister, said canister further including a plurality of bristles extending outwardly from an exterior surface of said canister;

a pair of axially opposed caps coupled to opposed ends of said canister; and, first and second handles directly connected to said end caps and extending outwardly from said canister along a path defined parallel to a longitudinal length of said canister;

wherein said end caps are intermediately coupled directly to said first and second handles as well as said vented canister respectively such that said first and second handles remain completely spaced exterior of said vented canister;

wherein said end caps are situated exterior of said vented canister.

2. The hairbrush of claim 1, wherein said first and second handles are removably connected to said end caps respectively.

3. The hairbrush of claim 1, wherein each of said end caps comprises:

a female coupling defining a hollow cavity formed in a lateral wall thereof, each of said first and second handles including a male coupling removably mated within a corresponding one of said female couplings such that each of said first and second handles are independently and simultaneously connected to said end caps respectively.

4. The hairbrush of claim 3, wherein said male couplings comprise:

an annular raised edge concentrically protruding about a circumference of medial ends of said first and second handles respectively, each of said raised edges defining a shoulder against which said female couplings engage for preventing axial movement during operating conditions.

5. A hairbrush comprising:

a vented canister including canister perforations formed therein for allowing air to freely flow through said canister, said canister further including a plurality of bristles extending outwardly from an exterior surface of said canister;

a pair of axially opposed caps coupled to opposed ends of said canister; and, first and second handles directly connected to said end caps and extending outwardly from said canister along a path defined parallel to a longitudinal length of said canister;

wherein said first and second handles remain statically engaged with said end caps such that said canister and said first and second handles rotate in sync;

wherein said end caps are intermediately coupled directly to said first and second handles as well as said vented canister respectively such that said first and second handles remain completely spaced exterior of said vented canister;

wherein said end caps are situated exterior of said vented canister.

6. The hairbrush of claim 5, wherein said first and second handles are removably connected to said end caps respectively.

7. The hairbrush of claim 5, wherein each of said end caps comprises:

a female coupling defining a hollow cavity formed in a lateral wall thereof, each of said first and second handles including a male coupling removably mated within a corresponding one of said female couplings such that each of said first and second handles are independently and simultaneously connected to said end caps respectively.

8. The hairbrush of claim 7, wherein said male couplings comprise:

an annular raised edge concentrically protruding about a circumference of medial ends of said first and second handles respectively, each of said raised edges defining a shoulder against which said female couplings engage for preventing axial movement during operating conditions.

9. A method of assembling a hairbrush with dual removable handles, said method comprising the steps of:

a. providing a bristle canister;

b. providing first and second handles having male coupling portions seated at opposed end portions thereof respectively;

c. providing first and second end caps having female coupling portions formed at opposed end portions thereof respectively;

d. securing said bristle canister in one hand;

e. securing one of said first and second handles in another hand;

f. inserting and engaging one of said female couplings with a corresponding one of said male couplings such that said one handle and said canister become securely lock together;

g. transferring said canister and said one handle to said one hand;

h. grasping another one of said first and second handles in said another hand; and, inserting and engaging corresponding ones of said female and male couplings together such that said canister and said another handle securely lock together.

* * * * *